US011428052B2

(12) United States Patent
Er et al.

(10) Patent No.: US 11,428,052 B2
(45) Date of Patent: Aug. 30, 2022

(54) JUMPER TUBE SUPPORT MEMBER

(71) Applicant: Halliburton Energy Services, Inc., Houston, TX (US)

(72) Inventors: Boon Yen Er, Singapore (SG); Ryan Michael Novelen, Grand Prairie, TX (US); Matthew Gommel, Richmond, TX (US); Austin Lee Wright, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 18 days.

(21) Appl. No.: 16/473,734

(22) PCT Filed: Jan. 23, 2019

(86) PCT No.: PCT/US2019/014675

§ 371 (c)(1),
(2) Date: Jun. 26, 2019

(87) PCT Pub. No.: WO2019/156810

PCT Pub. Date: Aug. 15, 2019

(65) Prior Publication Data

US 2021/0348448 A1 Nov. 11, 2021

Related U.S. Application Data

(60) Provisional application No. 62/628,775, filed on Feb. 9, 2018.

(51) Int. Cl.
*E21B 43/04* (2006.01)
*E21B 17/00* (2006.01)
(Continued)

(52) U.S. Cl.
CPC ..... *E21B 17/006* (2013.01); *E21B 19/16* (2013.01); *E21B 43/04* (2013.01); *E21B 17/042* (2013.01)

(58) Field of Classification Search
CPC ..... E21B 17/006; E21B 17/042; E21B 19/16; E21B 43/04
See application file for complete search history.

(56) References Cited

U.S. PATENT DOCUMENTS 8,893,789 B2 11/2014 Cunningham et al.
2006/0283604 A1 12/2006 Setterberg, Jr. et al.
(Continued)

FOREIGN PATENT DOCUMENTS

WO WO 2009/009358 A1 1/2009

OTHER PUBLICATIONS

International Search Report and the Written Opinion, dated Apr. 29, 2019, PCT/US2019/014675, 11 pages, ISA/KR.
(Continued)

*Primary Examiner* — D. Andrews
(74) *Attorney, Agent, or Firm* — Haynes and Boone, LLP

(57) ABSTRACT

A method and apparatus according to which a connection between first and second completion joints is made up. The first and second completion joints each include a base pipe and a shunt tube disposed along the base pipe. The respective base pipes of the first and second completion joints are threadably engaged to form a pin and box connection. The shunt tube of the first completion joint is coupled to the shunt tube of the second completion joint using a jumper tube. The jumper tube is supported at a position longitudinally between the respective shunt tubes of the first and second completion joints using a first support member. In some embodiments, the first support member is longitudinally slidable along the base pipe of the first or second completion joint to the position between the respective shunt tubes of the first and second completion joints.

9 Claims, 10 Drawing Sheets

(51) Int. Cl.
*E21B 19/16* (2006.01)
*E21B 17/042* (2006.01)

(56) References Cited

U.S. PATENT DOCUMENTS

| | | | | |
|---|---|---|---|---|
| 2009/0159270 | A1 | 6/2009 | Setterberg, Jr. et al. | |
| 2010/0059232 | A1 | 3/2010 | Langlais et al. | |
| 2012/0168159 | A1 | 7/2012 | Edwards et al. | |
| 2013/0220635 | A1* | 8/2013 | Greci | E21B 19/16 166/380 |
| 2013/0327542 | A1 | 12/2013 | Least et al. | |
| 2014/0158373 | A1 | 6/2014 | Least et al. | |
| 2014/0262332 | A1 | 9/2014 | McNamee et al. | |
| 2015/0345257 | A1 | 12/2015 | Veit | |
| 2018/0002989 | A1 | 1/2018 | Veit et al. | |
| 2019/0145231 | A1* | 5/2019 | Sessa | E21B 43/045 166/51 |

OTHER PUBLICATIONS

Search Report and Written Opinion issued for Singapore Patent Application No. 11202005436U, dated Nov. 12, 2021, 7 pages.

* cited by examiner

JUMPER TUBE SUPPORT MEMBER

CROSS-REFERENCE TO RELATED APPLICATION

This application is a U.S. National Stage patent application of International Application No. PCT/US2019/014675, filed Jan. 23, 2019, which claims the benefit of the filing date of, and priority to, U.S. Application No. 62/628,775, filed Feb. 9, 2018, the entire disclosures of which are hereby incorporated herein by reference.

TECHNICAL FIELD

The present disclosure relates generally to well completion and production operations and, more specifically, to facilitating the making-up of a completion joint on an oil or gas platform by utilizing a shunt system with a jumper tube support member.

BACKGROUND

In the process of completing an oil or gas well, a tubular is run down-hole and used to communicate fluids between the surface and the formation. During production, a well-screen assembly may be utilized to control and limit debris such as gravel, sand, or other particulates from entering the tubular and being communicated to the surface. The well-screen assembly is coupled to the tubular and includes several completion joints connected in series with one another. A gravel-packing operation may be utilized to form the filter around the well-screen assembly within the wellbore. During the gravel-packing operation, a slurry containing a particulate material is communicated from the surface to the wellbore. The particulate material is packed around the well-screen assembly to form a permeable mass, through which fluid is permitted to flow. Shunt tubes may be disposed longitudinally along the completion joints of the well-screen assembly to provide an alternate flow path for the slurry during the gravel-packing operation. The shunt tubes are in communication with the wellbore and operate to reduce sand-bridging during the gravel-packing operation, i.e., blockages formed in the wellbore by accumulated particulate material, which blockages could inhibit the flow of the slurry around the well-screen assembly. The shunt tubes are susceptible to damage when the tubular and well-screen are run down-hole from the surface. Further, under high pressures, at least certain ones of the shunt tubes such as, for example, jumper tubes made up between respective joints (i.e., transport tubes) of the well-screen assembly, are susceptible to lengthwise expansion, which expansion can cause "walking" of the jumper tubes about the circumference of the well screen assembly. This is especially true for jumper tubes that are only supported at their opposing end portions. Further still, a significant amount of time and tools are needed to install components capable of adequately protecting the shunt tubes before the completion joints are run down-hole. Therefore, what is needed is a method, apparatus, system, or assembly that addresses one or more of the foregoing issues, and/or one or more other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
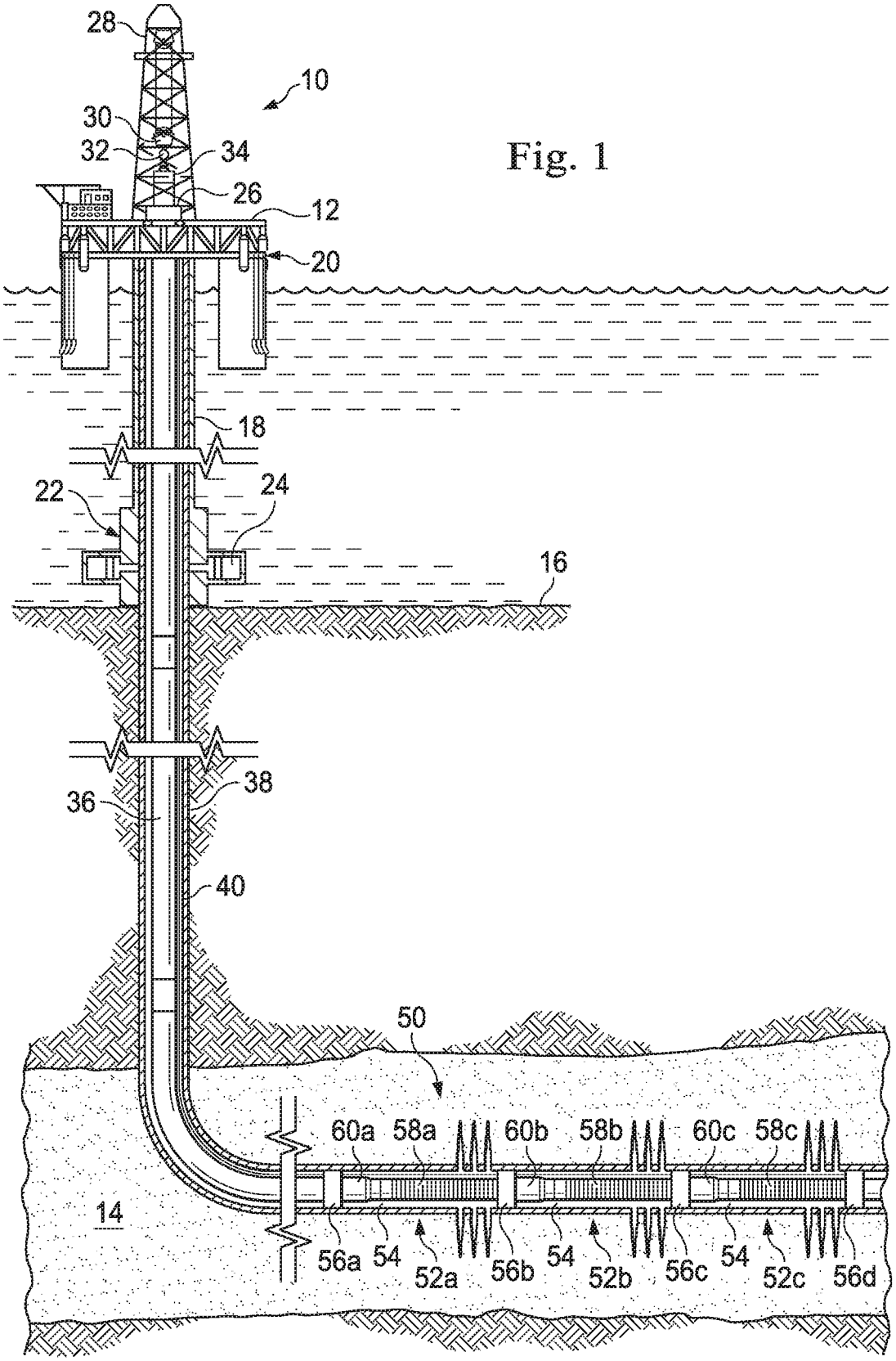
FIG. 1 is a schematic illustration of an offshore oil and gas platform operably coupled to a lower completion string disposed within a wellbore, the lower completion string including a well-screen assembly, according to one or more embodiments of the present disclosure.

Illustrative embodiments and related methods of the present disclosure are described below as they might be employed in a shunt system with a connection shroud secured by a centralizer. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "up-hole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

In an embodiment, as illustrated in FIG. 1, a lower completion string is installed in a well from an offshore oil or gas platform that is schematically illustrated and generally referred to by the reference numeral 10. A semi-submersible platform 12 is positioned over a submerged oil and gas formation 14 located below a sea floor 16. A subsea conduit 18 extends from a deck 20 of the platform 12 to a subsea wellhead installation 22, which includes blowout preventers 24. The platform 12 has a hoisting apparatus 26, a derrick 28, a travel block 30, a hook 32, and a swivel 34 for raising and lowering pipe strings, such as a substantially tubular, longitudinally extending tubular string 36.

A wellbore 38 extends through the various earth strata including the formation 14 and has a casing string 40 cemented therein. A generally tubular lower completion string 50 is connected to, and/or is part of, the tubular string 36. The lower completion string 50 is disposed in a substantially horizontal portion of the wellbore 38 and includes one or more completion sections 52 such as, for example, completion sections 52*a-c*. Completion sections 52*a-c* correspond to different regions of the formation 14. An annulus 54 is defined between the lower completion string 50 and the casing string 40. Isolation packers 56, such as, for example, isolation packers 56*a-d*, each form a seal preventing annular flow within the annulus 54 and fluidically isolating each of the completion sections 52*a-c*. In an embodiment, one or more of the isolation packers 56*a-d* are hydraulic set packers. In some embodiments, one or more of the isolation packers 56*a-d* are other types of packers that are not hydraulic set packers, such as, for example, mechanical set packers, tension set packers, rotation set packers, inflatable packers, another type of packer capable of sealing the annulus 54, or any combination thereof. Each completion section 52*a-c* includes a respective well-screen assembly 58*a-c* and a respective packing valve 60*a-c*. Several intervals of the casing string 40 are perforated adjacent the well-screen assemblies 58*a-c*.

Generally, with continuing reference to FIG. 1, the operation of the lower completion string 50 includes communicating a slurry, made up of a carrier fluid and a particulate material, within a work string from the surface to the completion sections 52*a-c*. The packing valves 60*a-c* correspond to the completion sections 52*a-c*, respectively, and direct the slurry into the annulus 54. The slurry flows through the perforations in the casing string 40 into the formation 14 and/or through the well-screen assembly 58 and back up the work string to the surface. In an embodiment, a fracturing operation is performed wherein the carrier fluid transports the particulate material (in this case, proppant) into the formation 14, thereby propping open induced fractures in the formation 14. In another embodiment, a gravel-packing operation is performed wherein the particulate material (in this case, gravel) is packed around the well-screen assembly 58 to form a gravel-pack filter, i.e., a permeable mass of gravel through which fluid is allowed to flow that prevents, or at least reduces, the flow of debris from the formation 14 into the well-screen assembly 58. During production, the well-screen assemblies 58*a-c* and the gravel-pack filters, in combination, control and limit debris such as gravel, sand, or other particulates from entering the lower completion string 50 and being communicated to the surface. The lower completion string 50 also includes a shunt system (not visible in FIG. 1) disposed longitudinally therealong. The shunt system provides an alternate flow path for the slurry during the gravel-packing operation, thereby preventing sand-bridging, i.e., blockages formed in the annulus 54 by accumulated gravel and/or other accumulated particulates. Such blockages might otherwise inhibit the flow of the slurry along the well-screen assembly 58 during the gravel-packing operation.

Although FIG. 1 depicts a horizontal wellbore, it should be understood by those skilled in the art that the embodiments of the present disclosure are equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "up-hole," "down-hole" and the like are used in relation to the illustrative embodiments as they are depicted in the figures, the upward direction being toward the top of the corresponding figure and the downward direction being toward the bottom of the corresponding figure, the up-hole direction being toward the surface of the well, the down-hole direction being toward the toe of the well. Also, even though FIG. 1 depicts an offshore operation, it should be understood by those skilled in the art that the embodiments of the present disclosure are equally well suited for use in onshore operations. Further, even though FIG. 1 depicts a cased hole completion, it should be understood that the embodiments of the present disclosure are equally well suited for use in open hole completions.

As indicated above, each completion section 52*a-c* includes respective ones of the isolation packers 56*a-c*, the well-screen assemblies 58*a-c*, and the packing valves 60*a-c*. The completion sections 52*a-c* are substantially identical to one another. Therefore, in connection with FIGS. 2 and 3A-3E, only one of the completion sections 52*a-c* will be described in detail below using the foregoing reference numerals, but the suffixes a-c will be omitted to indicate that the description below applies to any one of the completion sections 52*a-c*.

Figure 2:
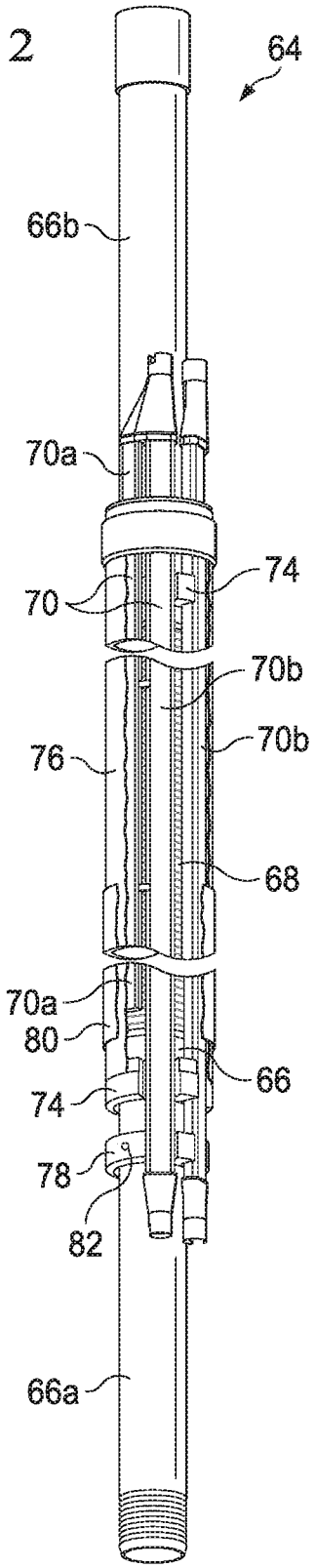
FIG. 2 is a perspective partial cut-away view of a completion joint from the well-screen assembly of FIG. 1, according to one or more embodiments of the present disclosure.

Referring to FIG. 2 with continuing reference to FIG. 1, the well-screen assembly 58 includes a plurality of completion joints 64 made up in series with one another, one of which is shown in FIG. 2. Each completion joint 64 is made-up as part of the well-screen assembly 58 before it is run downhole from the oil or gas platform 10 for completion operations. Each completion joint 64 includes a base pipe 66 and a screen 68 concentrically disposed thereabout. The base pipe 66 has an end portion 66*a* and an end portion 66*b*. A plurality of openings are formed along intervals in the base pipe 66 beneath the screen 68, thereby allowing fluid to pass into the lower completion string 50. In an embodiment, the screen 68 is a filter formed of wire or synthetic mesh disposed along the outer surface of the base pipe 66. In some embodiments, the screen 68 is an elongated tubular member disposed on the base pipe 66 so as to define an annular flow passage between the base pipe 66 and the screen 68. The annular flow passage directs fluid flow towards the plurality of openings in the base pipe 66 and into the lower completion string 50. Each completion joint 64 may also include one or more shunt tubes 70 longitudinally disposed along the outer surface of the base pipe 66 and the screen 68. Each shunt tube 70 may include a packing tube 70*a* and a transport tube 70*b* spaced in a parallel relation. The packing tube 70*a* branches off from the transport tube 70*b* and includes nozzles that direct the flow of slurry into the annulus 54. Jumper tubes 70*c* (shown in FIGS. 3C and 3D) are configured to be connected between the corresponding transport tubes 70*b* of the respective completion joints 64, as will be described in further detail below.

The packing tubes 70*a* and/or the transport tubes 70*b* are supported in place by support members 74. The support members 74 are disposed about the base pipe 66 and support the packing tubes 70*a* and/or the transport tubes 70*b* in a generally parallel orientation relative to one another. A tubular outer shroud 76 is disposed about the completion joint 64 and mounted over the support members 74, thereby covering respective portions of the base pipe 66, the screen 68, and the shunt tubes 70. Each completion joint 64 also includes a support member 78 and a tubular sliding shroud 80. The support member 78 is slidably coupled about the end portion 66*a* of the base pipe 66 and includes a locking device 82 (e.g., set screws or the like) engageable to prevent longitudinal movement of the support member 78 relative to the base pipe 66. In some embodiments, the support member 78 is initially positioned beneath the transport tubes 70*b* and adjacent the lowermost support member 74 of the completion joint 64. In addition, or instead, a support member substantially identical to the support member 78 may be slidably coupled about the end portion 66*b* of the base pipe 66—in some such embodiments, the support member is initially positioned beneath the transport tubes 70*b* and adjacent the uppermost support member 74 of the completion joint 64. The tubular sliding shroud 80 is slidably coupled about the completion joint 64 and mountable over the support member 78. In some embodiments, the sliding shroud 80 is initially positioned about the outer shroud 76 of the completion joint 64.

The packing tubes 70*a*, the transport tubes 70*b*, and the jumper tubes 70*c* each form part of the above-described shunt system. Thus, during the gravel-packing operation, in some embodiments, the packing tubes 70*a*, the transport tubes 70*b*, and the jumper tubes 70*c* operate to prevent sand-bridging. More particularly, when a sand-bridge begins to form in the annulus 54, the slurry is forced to enter the transport tubes 70*b* from the annulus 54. The slurry then flows along the well-screen assembly 58, through the transport tubes 70*b* and the jumper tubes 70*c* (i.e., from one completion joint 64 to the next) until the slurry bypasses the sand-bridge, at which point the slurry flows from the transport tubes 70*b* into the packing tubes 70*a* and is directed back into the annulus 54 by the nozzles.

Figure 3A:
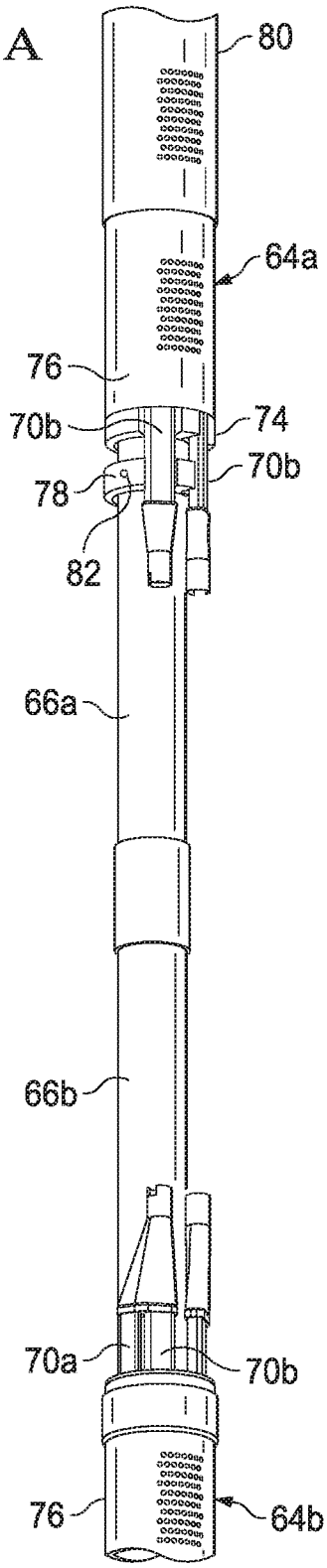
FIG. 3A is a perspective partial cut-away view of the well-screen assembly of FIG. 1 in a first state, which well-screen assembly includes a pair of the completion joints of FIG. 2 connected in series with one another, according to one or more embodiments of the present disclosure.

In an embodiment, the well-screen assembly 58 includes several completion joints 64 connected in series with one another, a pair of which are illustrated in FIGS. 3A-3E. In order to assemble the well-screen assembly 58, successive connections are made-up between adjacent ones of the completion joints 64 on the floor of the oil or gas platform 10. Each successive connection is made-up after the previously connected pair of completion joints 64 have been displaced toward the wellbore 38 and/or the casing string 40. The process of making-up the connection between adjacent ones of the completion joints 64 will be described in detail below. Specifically, in connection with FIGS. 3A-3E, the process of connecting a completion joint 64*a* to a completion joint 64*b* will be described, the completion joints 64*a* and 64*b* being substantially identical to the completion joint 64 described above. As shown in FIG. 3A, the completion joints 64*a* and 64*b* are first connected in series with one another. More particularly, the end portion 66*a* of the completion joint 64*a*'s base pipe 66 is threadably connected to the end portion 66*b* of the completion joint 64*b*'s base pipe 66, as shown in FIG. 3A, thereby forming a pin and box connection and providing fluid communication between the respective base pipes 66 of the completion joints 64*a* and 64*b*. At least respective portions of the pin and box connection (or any other type of connection that may be used to connect the respective base pipes 66 of the completions joints 64*a* and 64*b*) are considered to include or be part of the completion joint 64*a*'s base pipe 66 and/or the completion joint 64*b*'s base pipe 66. Thus, the support member 78 may be coupled to the pin and box connection (or any other type of connection that may be used to connect the respective base pipes 66 of the completions joints 64*a* and 64*b*) and still be considered to be coupled to one, or both, of the base pipes 66 of the completions joints 64*a* and 64*b*.

Figure 3B:
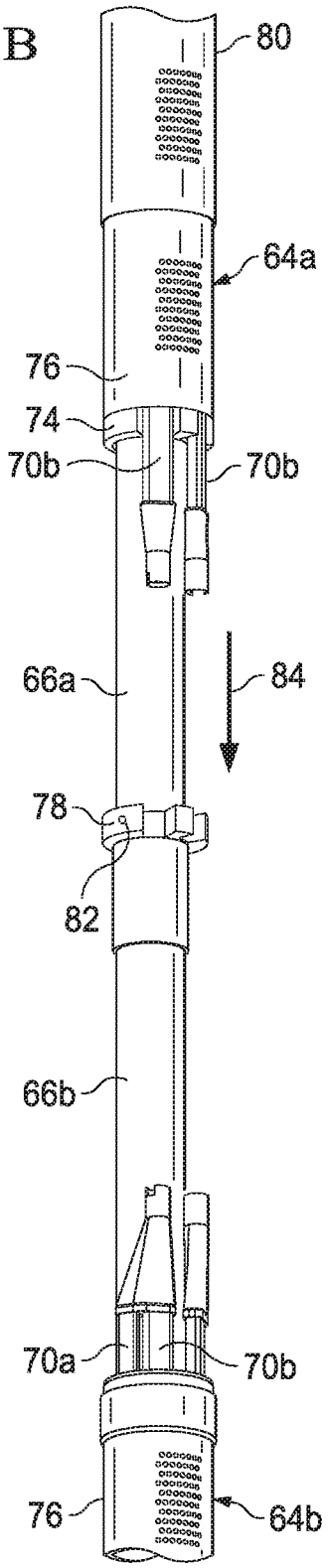
FIG. 3B is a perspective partial cut-away view of the well-screen assembly of FIG. 3A in a second state, according to one or more embodiments of the present disclosure.

Once the respective base pipes 66 of the completion joints 64*a* and 64*b* have been connected, the support member 78 is slidably displaced in a longitudinal direction 84 towards the pin and box connection, as shown in FIG. 3B. The locking device 82 is then engaged to lock the support member 78 to the base pipe 66 of the completion joint 64*a* at or near the pin and box connection. In some embodiments, in addition to, or instead of, the support member 78, a support member that is substantially identical to the support member 78 is slidably coupled about the base pipe 66 of the completion joint 64*b*. Such a support member is slidably displaceable towards the pin and box connection in a longitudinal direction opposite the longitudinal direction 84, and is configured to be locked to the base pipe 66 of the completion joint 64*b* at or near the pin and box connection.

Figure 3C:
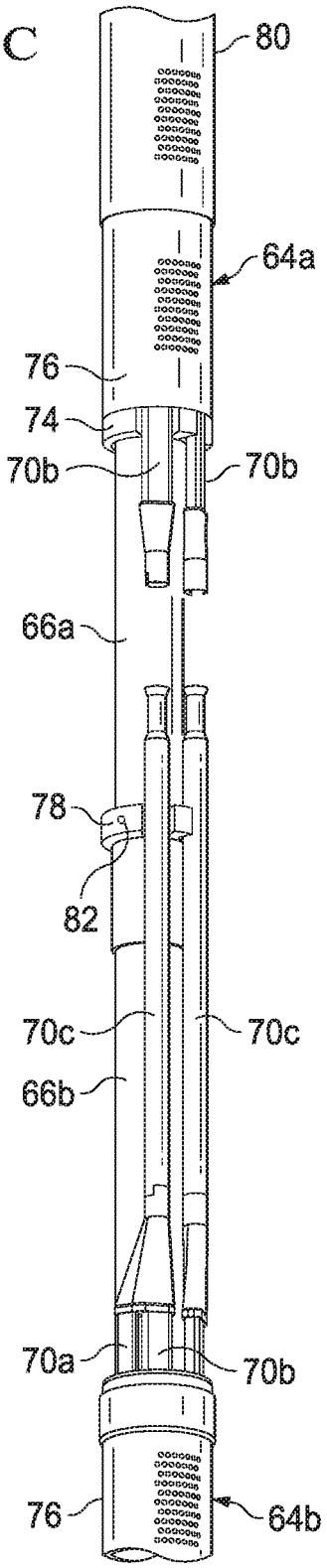
FIG. 3C is a perspective partial cut-away view of the well-screen assembly of FIGS. 3A and 3B in a third state, according to one or more embodiments of the present disclosure.
Figure 3D:
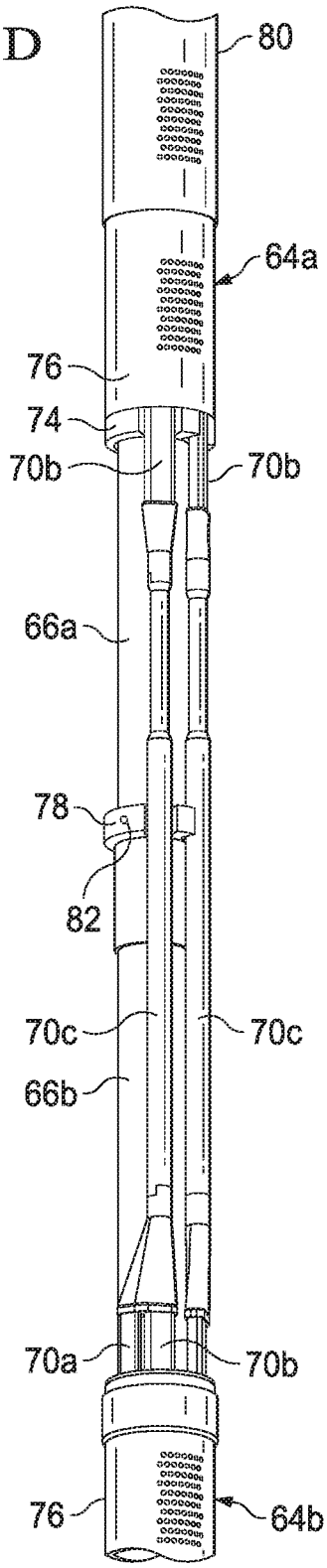
FIG. 3D is a perspective partial cut-away view of the well-screen assembly of FIGS. 3A-3C in a fourth state, according to one or more embodiments of the present disclosure.

Once the support member 78 has been properly positioned and locked into place at or near the pin and box connection, the jumper tubes 70*c* are installed, as shown in FIGS. 3C and 3D. More particularly, the jumper tubes 70*c* are first coupled to the transport tubes 70*b* of the completion joint 64*b*, and then telescoped towards, and coupled to, the transport tubes 70*b* of the completion joint 64*a*. Alternatively, at least one of the jumper tubes 70*c* may first be coupled to the transport tube(s) 70*b* of the completion joint 64*a*, and then telescoped towards, and coupled to, the corresponding transport tube(s) 70*b* of the completion joint 64*b*. In any case, the jumper tubes 70*c* couple each transport tube 70*b* disposed along the completion joint 64*a* to the corresponding transport tube 70*b* disposed along the completion joint 64*b*, thereby providing fluid communication between the respective transport tubes 70*b* of the completion joints 64*a* and 64*b*. Once installed, the support member 78 (and/or another support member) supports the jumper tubes 70*c* in a generally parallel orientation relative to one another.

As a result, during the installation and/or operation of the well-screen assembly 58, the support member 78 prevents the jumper tubes 70*c* from any "walking" about the circumference of the base pipes 66 that may be caused by lengthwise expansion (e.g., due to high pressures) of the jumper tubes 70*c*. In some embodiments, the support member 78 increases the reliability of the connection between successive completion joints 64, and reduces the potential for failures in comparison with commonly used designs in shunt systems. In some embodiments, especially during higher pressure gravel packing operations, the support member 78 helps to alleviate distortion (e.g., lengthwise extension, bending, twisting, or the like) of the jumper tubes 70*c* connected between the respective transport tubes 70*b* of adjacent completion joints 64 so that the gravel packing operation can be successfully executed at the higher pressure. In some embodiments, the support member 78 increases the pressure rating of the shunt system of the present disclosure.

Figure 3E:
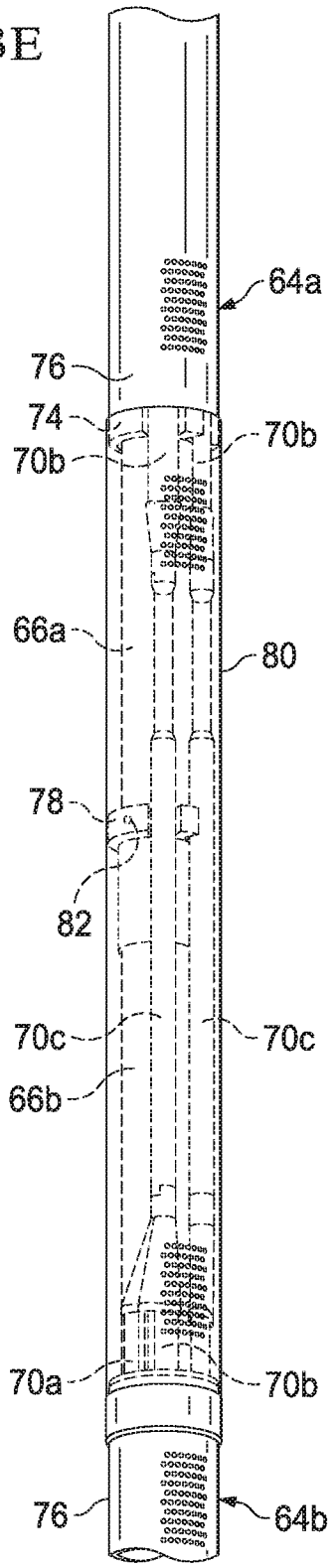
FIG. 3E is a perspective partial cut-away view of the well-screen assembly of FIGS. 3A-3D in a fifth state, according to one or more embodiments of the present disclosure.

Once the completion joints 64*a* and 64*b* have been connected as described above, the sliding shroud 80 may be displaced from its initial position, as shown in FIGS. 3A-3D, to a run-in position, as shown in FIG. 3E. In the run-in position, the sliding shroud 80 is disposed about the jumper tubes 70*c*, the support member 78 (and/or another support member), and respective portions of the completion joints 64*a* and 64*b*, thereby covering and protecting the jumper tubes 70*c* when the completion joints 64*a* and 64*b* are disposed within the wellbore 38. The sliding shroud 80 may be retained in the run-in position by a retaining mechanism operable to secure the sliding shroud 80 to the completion joints 64*a* and 64*b*. When the sliding shroud 80 is retained in the run-in position, respective portions of the base pipes 66 and the shunt tubes 70 that are longitudinally disposed between the outer shrouds 76 of the completion joints 64*a* and 64*b* are covered by the sliding shroud 80. During the installation and/or operation of the well-screen assembly 58, the sliding shroud 80 protects the connection between the completion joint 64*a* and the completion joint 64*b*, including at least the jumper tubes 70*c*, from any damaging impacts. In some embodiments, the sliding shroud 80 increases the reliability of the connection between successive completion joints 64, reduces the potential for failures in comparison with commonly used designs in shunt systems, and shortens the installation time of successive completion joints 64 on the oil or gas platform 10.

Figure 4A:
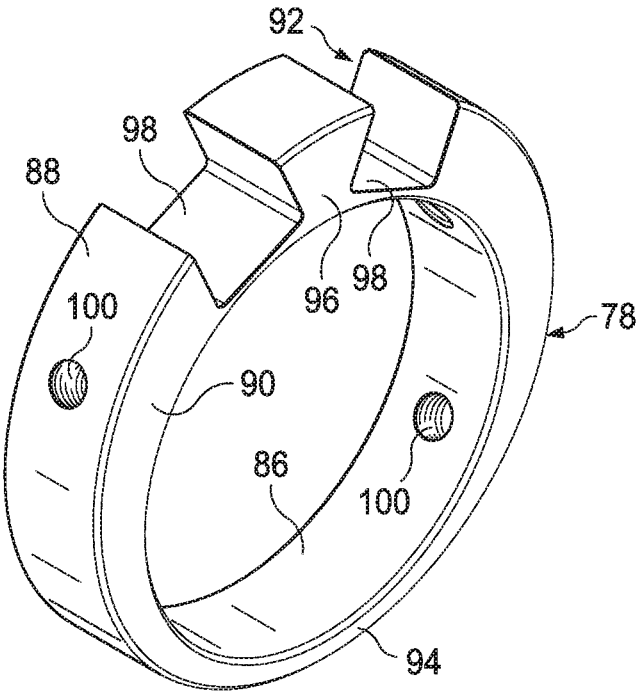
FIG. 4A is a perspective view of a first embodiment of the support member of FIGS. 2 AND 3A-3E, according to one or more embodiments of the present disclosure.

Referring to FIG. 4A, an embodiment of the support member 78 is illustrated—in the embodiment shown, the support member 78 is a generally tubular member including an interior surface 86, an exterior surface 88, and a pair of opposing end surfaces 90 and 92. In some embodiments, the interior surface 86 is not concentric with the exterior surface 88—as a result, the support member 78 defines a reduced-thickness portion 94 and an enlarged-thickness portion 96. A pair of longitudinal grooves 98 are formed into the exterior surface 88 of the support member 78 at the enlarged-thickness portion 96. The longitudinal grooves 98 are configured to receive and support the jumper tubes 70*c* as described above. In some embodiments, the locking device 82 includes set screws received within threaded openings 100 formed through the support ring 78.

Figure 4B:
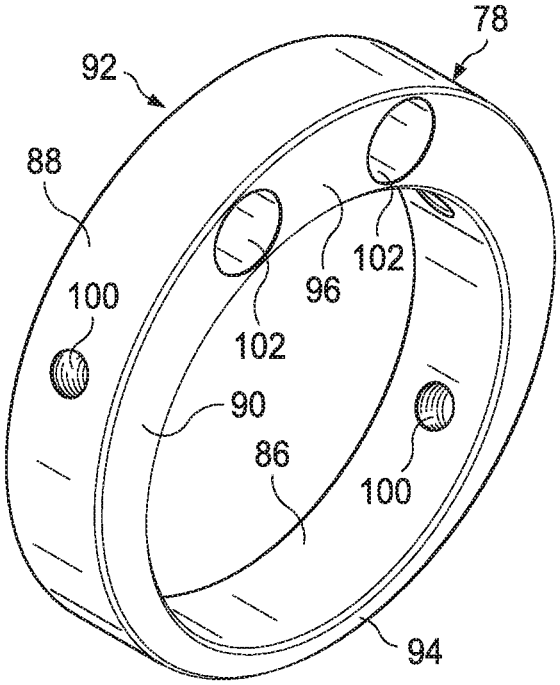
FIG. 4B is a perspective view of a second embodiment of the support member of FIGS. 2 AND 3A-3E, according to one or more embodiments of the present disclosure.

Turning to FIGS. 4B-4F, various embodiments of support members that may be used to support the jumper tubes 70*c* in addition to, or instead of, the support member 78 are illustrated. For example, the support member shown in FIG. 4B is substantially identical to the support member 78, except that the longitudinal grooves 98 are omitted in favor of longitudinal openings 102 formed through the end surfaces 90 and 92.

Figure 4C:
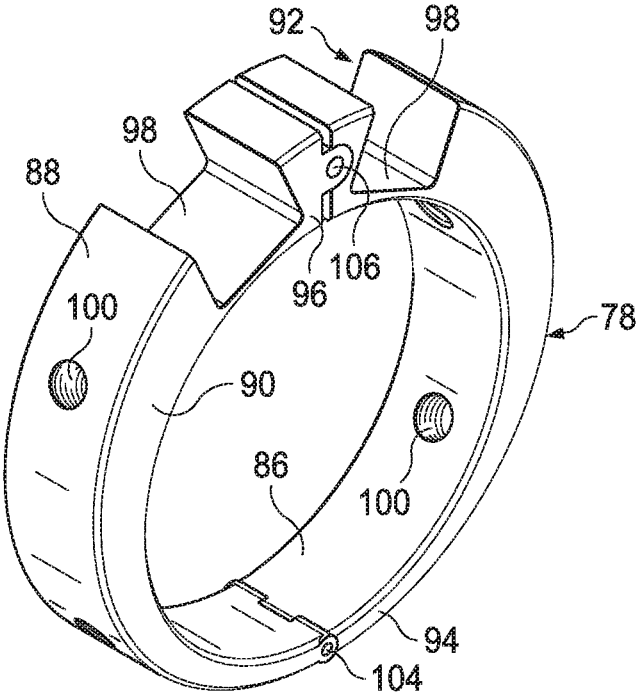
FIG. 4C is a perspective view of a third embodiment of the support member of FIGS. 2 AND 3A-3E, according to one or more embodiments of the present disclosure.

For another example, the support member shown in FIG. 4C is substantially identical to the support member 78, except that the reduced-thickness portion 94 includes a hinge 104 and the enlarged-thickness portion 96 includes a closure member 106 located, for example, between the respective longitudinal grooves 98. In some embodiments, the support member of FIG. 4C may be secured to the base pipe 66 of the completion joint 64*a* or 64*b* after the respective base pipes 66 of the completion joints 64*a* and 64*b* have been connected to form the pin and box connection.

Figure 4D:
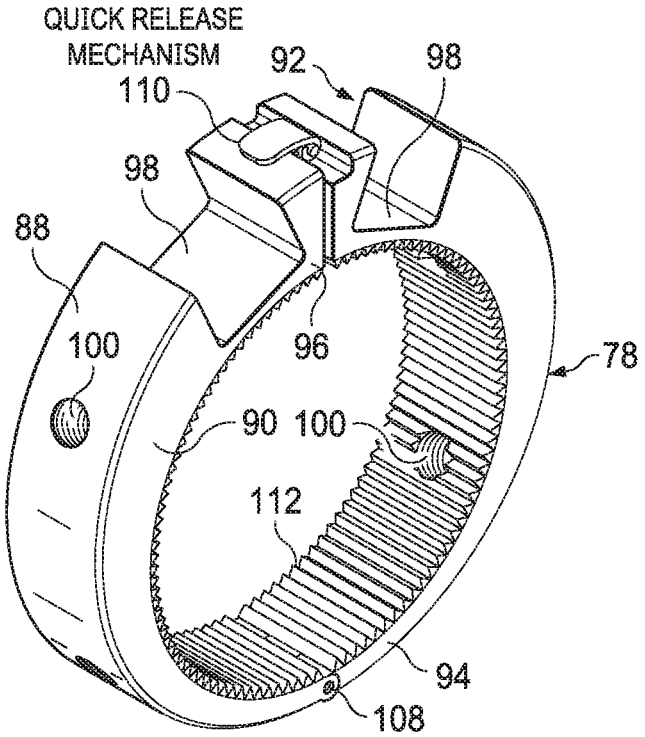
FIG. 4D is a perspective view of a fourth embodiment of the support member of FIGS. 2 AND 3A-3E, according to one or more embodiments of the present disclosure.

For yet another example, the support member shown in FIG. 4D is substantially identical to the support member 78, except that the reduced-thickness portion 94 includes a hinge 108, the enlarged-thickness portion 96 includes a quick release member 110 located, for example, between the respective longitudinal grooves 98, and the interior surface 86 includes a plurality of teeth 112 configured to prevent longitudinal displacement of the support member along the base pipe 66. In some embodiments, the support member of FIG. 4D may be secured to the base pipe 66 of the completion joint 64*a* or 64*b* after the respective base pipes 66 of the completion joints 64*a* and 64*b* have been connected to form the pin and box connection.

Figure 4E:
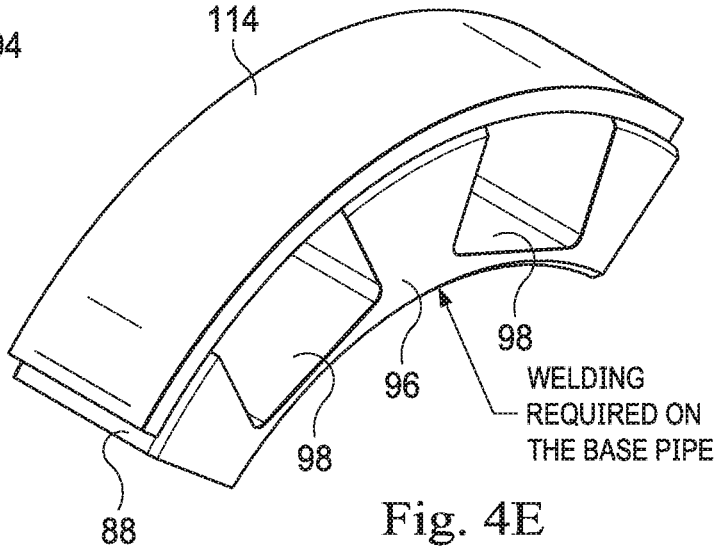
FIG. 4E is a perspective view of a fifth embodiment of the support member of FIGS. 2 AND 3A-3E, according to one or more embodiments of the present disclosure.

For yet another example, the support member shown in FIG. 4E is substantially identical to the support member 78, except that the reduced-thickness portion 94 has been omitted so that the support member is not tubular in shape. Moreover, a semi-cylindrical retainer 114 is positioned over the longitudinal grooves 98 formed in the enlarged-thickness portion 96—the retainer 114 is configured to retain the jumper tubes 70*c* in the longitudinal grooves 98. In some embodiments, the support member of FIG. 4E may be secured to the base pipe 66 of the completion joint 64*a* or 64*b* (via, for example, welding) before the respective base pipes 66 of the completion joints 64*a* and 64*b* have been connected to form the pin and box connection.

Figure 4F:
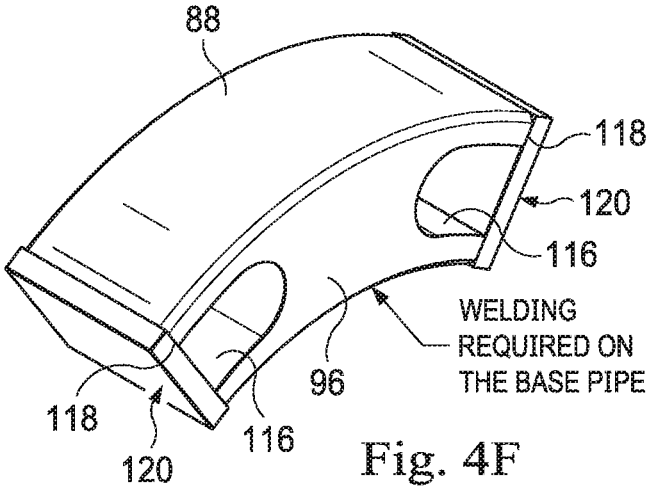
FIG. 4F is a perspective view of a sixth embodiment of the support member of FIGS. 2 AND 3A-3E, according to one or more embodiments of the present disclosure.

For a final example, the support member shown in FIG. 4F is substantially identical to the support member 78, except that the reduced-thickness portion 94 has been omitted so that the support member is not tubular in shape. Moreover, the longitudinal grooves 98 are omitted in favor of a pair of longitudinal grooves 116 formed into opposing side surfaces 118 of FIG. 4F's support member. A pair of retainers 120 are positioned over the longitudinal grooves 116 formed in the opposing side surfaces 118—the retainers 120 are configured to retain the jumper tubes 70*c* in the longitudinal grooves 116. In some embodiments, the support member of FIG. 4F may be secured to the base pipe 66 of the completion joint 64*a* or 64*b* (via, for example, welding) before the respective base pipes 66 of the completion joints 64*a* and 64*b* have been connected to form the pin and box connection.

Figure 5:
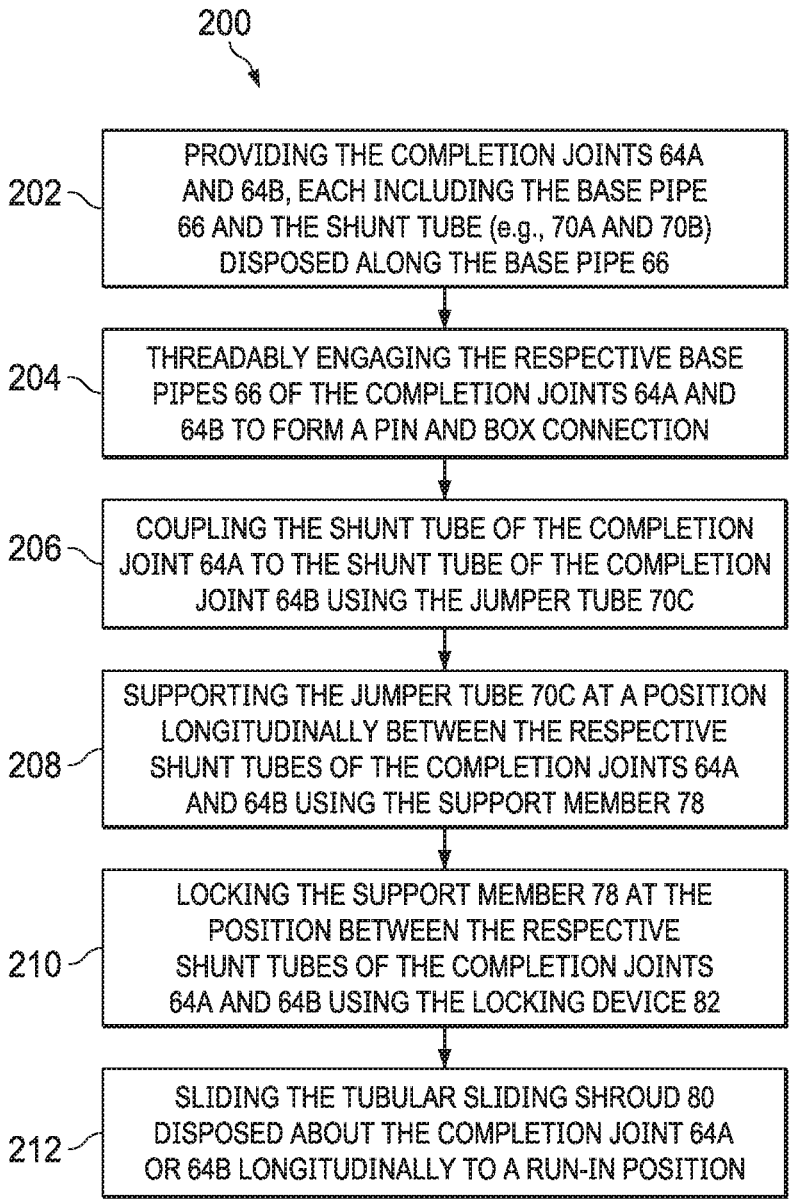
FIG. 5 is a flow diagram of a method for implementing one or more embodiments of the present disclosure.

Referring to FIG. 5, a method is diagrammatically illustrated and generally referred to by the reference numeral 200—in some embodiments, the method 200 is executable on the floor of the oil or gas platform 10 to make up a connection between the completion joints 64*a* and 64*b*. The method 200 includes providing the completion joints 64*a* and 64*b*, each including the base pipe 66 and the shunt tube (e.g., 70*a* and 70*b*) disposed along the base pipe 66 at a step 202, threadably engaging the respective base pipes 66 of the completion joints 64*a* and 64*b* to form a pin and box connection at a step 204, coupling the shunt tube of the completion joint 64*a* to the shunt tube of the completion joint 64*b* using the jumper tube 70*c* at a step 206, supporting the jumper tube 70*c* at a position longitudinally between the respective shunt tubes of the completion joints 64*a* and 64*b* using the support member 78 at a step 208, locking the support member 78 at the position between the respective shunt tubes of the completion joints 64*a* and 64*b* using the locking device 82 at a step 210, and sliding the tubular sliding shroud 80 disposed about the completion joint 64*a* or 64*b* longitudinally to a run-in position at a step 212. In the run-in position, the tubular sliding shroud 80 is disposed about the jumper tube 70*c* and respective portions of the completion joints 64*a* and 64*b*, thereby covering the jumper tube 70*c*. In some embodiments, the completion joints 64*a* and 64*b* each include a second support member coupled to the base pipe and configured to support the shunt tube.

In some embodiments, the step 208 includes sliding the first support member longitudinally along the base pipe of the first or second completion joint to the position between the respective shunt tubes of the completion joints 64*a* and 64*b*. In some embodiments, the first support member is generally tubular in shape and includes a pair of longitudinal grooves formed in an exterior surface thereof. In some embodiments, the first support member includes at least one retainer configured to retain the jumper tubes in the longitudinal grooves. In some embodiments, the first support member includes a hinge, and the step 208 includes coupling the first support member to the base pipe of the first or second completion joint after the respective base pipes of the completion joints 64*a* and 64*b* have been threadably engaged to form the pin and box connection.

In some embodiments, the completion joints 64*a* and 64*b* each include a tubular outer shroud disposed about respective portions of the shunt tube and the base pipe. In some embodiments, respective portions of the base pipes and the shunt tubes that are longitudinally disposed between the tubular outer shrouds of the completion joints 64*a* and 64*b* are covered by the tubular sliding shroud when the tubular sliding shroud is placed in the run-in position.

The present disclosure introduces an apparatus including first and second completion joints, each including a base pipe and a shunt tube disposed along the base pipe; a jumper tube coupling the shunt tube of the first completion joint to the shunt tube of the second completion joint; and a first support member coupled to the base pipe of the first or second completion joint to support the jumper tube at a position longitudinally between the respective shunt tubes of the first and second completion joints; wherein the respective base pipes of the first and second completion joints are threadably engaged to form a pin and box connection. In some embodiments, the first support member is slid ably coupled about the base pipe of the first or second completion joint and longitudinally displaceable to support the jumper tube at the position between the respective shunt tubes of the first and second completion joints. In some embodiments, the first support member includes a locking device configured to lock the first support member at the position between the respective shunt tubes of the first and second completion joints. In some embodiments, the first support member is generally tubular in shape and includes a pair of longitudinal grooves formed in an exterior surface thereof. In some embodiments, the first support member includes at least one retainer configured to retain the jumper tubes in the longitudinal grooves. In some embodiments, the first support member includes a hinge and is couplable to the base pipe of the first or second completion joint after the respective base pipes of the first and second completion joints have been threadably engaged to form a pin and box connection. In some embodiments, the apparatus further includes a tubular sliding shroud disposed about one of the first and second completion joints and adapted to slide longitudinally to a run-in position, wherein, in the run-in position, the tubular sliding shroud is disposed about the jumper tube and respective portions of the first and second completion joints, thereby covering the jumper tube. In some embodiments, the first and second completion joints each include a tubular outer shroud disposed about respective portions of the shunt tube and the base pipe. In some embodiments, respective portions of the base pipes and the shunt tubes that are longitudinally disposed between the tubular outer shrouds of the first and second completion joints are covered by the tubular sliding shroud when the tubular sliding shroud is placed in the run-in position. In some embodiments, the apparatus further includes a second support member coupled to the base pipe of the first or second completion joint and configured to support the shunt tube.

The present disclosure also introduces a method for making up a connection between first and second completion joints, the method including providing first and second completion joints, each including a base pipe and a shunt tube disposed along the base pipe; threadably engaging the respective base pipes of the first and second completion joints to form a pin and box connection; coupling the shunt tube of the first completion joint to the shunt tube of the second completion joint using a jumper tube; and supporting the jumper tube at a position longitudinally between the respective shunt tubes of the first and second completion joints using a first support member. In some embodiments, supporting the jumper tube at the position longitudinally between the respective shunt tubes of the first and second completion joints using the first support member includes sliding the first support member longitudinally along the base pipe of the first or second completion joint to the position between the respective shunt tubes of the first and second completion joints. In some embodiments, the method further includes locking the first support member at the position between the respective shunt tubes of the first and second completion joints using a locking device. In some embodiments, the first support member is generally tubular in shape and includes a pair of longitudinal grooves formed in an exterior surface thereof. In some embodiments, the first support member includes at least one retainer configured to retain the jumper tubes in the longitudinal grooves. In some embodiments, the first support member includes a hinge; and supporting the jumper tube at the position longitudinally between the respective shunt tubes of the first and second completion joints using the first support member includes coupling the first support member to the base pipe of the first or second completion joint after the respective base pipes of the first and second completion joints have been threadably engaged to form the pin and box connection. In some embodiments, the method further includes sliding a tubular sliding shroud disposed about one of the first and second completion joints longitudinally to a run-in position, wherein, in the run-in position, the tubular sliding shroud is disposed about the jumper tube and respective portions of the first and second completion joints, thereby covering the jumper tube. In some embodiments, the first and second completion joints each include a tubular outer shroud disposed about respective portions of the shunt tube and the base pipe. In some embodiments, respective portions of the base pipes and the shunt tubes that are longitudinally disposed between the tubular outer shrouds of the first and second completion joints are covered by the tubular sliding shroud when the tubular sliding shroud is placed in the run-in position. In some embodiments, the first and second completion joints each include a second support member coupled to the base pipe and configured to support the shunt tube.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, means plus function clauses are intended to cover the structures described herein as performing the recited function and not only structural equivalents, but also equivalent structures.

What is claimed is:

1. A completion joint assembly for downhole deployment, the completion joint assembly comprising:

a base pipe having a first end and a second end;

a screen disposed about the base pipe between the base pipe ends;

a first shunt tube support disposed about the base pipe between the base pipe first end and the screen;

a second shunt tube support disposed about the base pipe between the base pipe second end and the screen;

a shunt tube extending between and supported by the first and second shunt tube supports, the shunt tube having a first end and a second end, wherein the shunt tube first end extends from the first shunt tube support towards the first base pipe end and wherein the shunt tube second end extends from the second shunt tube support towards the second base pipe end;

a fixed outer shroud disposed about the base pipe radially outward from the shunt tube and extending between and fixedly supported by the first and second shunt tube supports;

a jumper tube coupled to the first end of the shunt tube; and a jumper tube support member coupled to the base pipe between the first shunt tube support and the base pipe first end, the jumper tube support spaced apart from the first shunt tube support and the fixed outer shroud, wherein the jumper tube support member is adjustably positionable along the base pipe adjacent the base pipe first end and selectively lockable to support the jumper tube.

2. The completion joint assembly of claim 1, wherein the jumper tube support member includes a locking device configured to lock the jumper tube support member adjacent the base pipe first end.

3. The completion joint assembly of claim 1, wherein the jumper tube support member is generally tubular in shape and includes a pair of longitudinal grooves formed in an exterior surface thereof.

4. The completion joint assembly of claim 3, wherein the jumper tube support member includes at least one retainer configured to retain the jumper tubes in the longitudinal grooves.

5. The completion joint assembly of claim 1, wherein the jumper tube support member includes a hinge.

6. The completion joint assembly of claim 1, further comprising a tubular jumper tube shroud disposed about the base pipe radially outward from the jumper tube, the jumper tube shroud supported by the jumper tube support member.

7. A method for making up a connection between first and second completion joints, the method comprising:

providing the first and second completion joints, each completion joint including a base pipe, a shunt tube disposed along the base pipe, and at least two fixed shunt tube supports supporting the shunt tube and a fixed shroud radially outward from the base pipe;

coupling the respective base pipes of the first and second completion joints to form a joint therebetween;

coupling the shunt tube of the first completion joint to the shunt tube of the second completion joint using a jumper tube;

sliding a jumper tube support member along a base pipe from adjacent a fixed shunt tube support to adjacent the joint; and supporting the jumper tube with the jumper tube support member at a position longitudinally between the respective shunt tubes of the first and second completion joints.

8. The method of claim 7, further comprising securing the position of the jump tube support member by locking the jump tube support member adjacent the joint and spaced apart from the fixed shunt tube supports.

9. The method of claim 7, further comprising sliding a tubular sliding shroud disposed about one of the first and second completion joints longitudinally to a position adjacent the jumper tube so as to be supported by the jumper tube support member, thereby covering the jumper tube.

* * * * *